United States Patent [19]

Brinkmann et al.

[11] Patent Number: 4,607,725

[45] Date of Patent: Aug. 26, 1986

[54] SAFETY LADDER

[75] Inventors: Arnfried Brinkmann; Ernst Lehners, both of Essen, Fed. Rep. of Germany

[73] Assignee: Fahrleitungsbau GmbH, Essen, Fed. Rep. of Germany

[21] Appl. No.: 790,963

[22] Filed: Oct. 24, 1985

[30] Foreign Application Priority Data

Nov. 7, 1984 [DE] Fed. Rep. of Germany ..... 3440549

[51] Int. Cl.[4] ..... E06C 7/08

[52] U.S. Cl. ..... 182/189; 182/8; 182/100

[58] Field of Search ..... 182/8, 100, 189, 228

[56] References Cited

U.S. PATENT DOCUMENTS

| | | | |
|---|---|---|---|
| 288,977 | 11/1883 | Churchill | 182/189 |
| 591,418 | 10/1897 | La Verne et al. | 182/189 |
| 950,182 | 2/1910 | Mercer | 182/189 |
| 973,103 | 10/1910 | Boyd | 182/189 |
| 2,924,291 | 2/1960 | Tunstead | 182/189 |
| 2,957,538 | 10/1960 | Pottmeyer | 182/189 |
| 4,069,892 | 1/1978 | Lynne | 182/189 |
| 4,388,983 | 6/1983 | Bartels | 182/100 |

FOREIGN PATENT DOCUMENTS

| | | | |
|---|---|---|---|
| 2060718 | 6/1972 | Fed. Rep. of Germany | 182/8 |

OTHER PUBLICATIONS

"FABA Steigschutz", (FABA Safety Ladder) of Fahrleitungsbau GmbH.

*Primary Examiner*—Reinaldo P. Machado
*Attorney, Agent, or Firm*—Karl F. Ross; Herbert Dubno

[57] ABSTRACT

A safety ladder comprises a vertical central ladder stringer and a plurality of horizontal rungs attached thereto, wherein the central ladder stringer has a substantially C-shaped cross section with a front longitudinal slot, a rear transverse piece lying opposite to the longitudinal slot, this rear transverse piece having rounded longitudinal edges. The rungs are attached from the outside to the central ladder stringer and are bent with their free outer members forward. In order to provide a better distribution of the climbing forces without impairing any corrosion protection measures or obstructing the interior of the longitudinal slot, the rungs are provided with a preferably equal sided, trapezoidally shaped recess for the rear transverse piece, by which the rungs sit riderlike on the central ladder stringer contacting only in the vicinity of the longitudinal edges of the ladder stringer and the rungs are attached to the central ladder stringer by a fastening means. The fastening means preferably comprises at least one rivet which penetrates the rear transverse piece and the rung.

7 Claims, 4 Drawing Figures

SAFETY LADDER

FIELD OF THE INVENTION

Our present invention relates to a safety ladder for buildings, electrical towers, underground shafts, and the like, and, more particularly, to safety ladders to be used in conjunction with a safety belt or harness having a releasable tether to guarantee a safe ascent and descent on tall buildings, high voltage towers, and the like, and in deep underground shafts.

BACKGROUND OF THE INVENTION

A safety ladder can comprise a vertical central ladder stringer and a plurality of horizontal rungs. The central ladder stringer can have a substantially C-shaped cross section with a front longitudinal slot, has a substantially planar rear transverse piece with rounded longitudinal edges. The rungs applied in the vicinity of the rear transverse piece from the outside to the central ladder stringer are attached thereto. The outer ends of the rungs are usually bent forwardly.

Safety ladders of these type are intended to protect a user from a possible fall and serious injury. For this purpose the user must wear a safety belt and harness having a releasable tethering device for attachment to the safety ladder, which is usually insertable in the longitudinal slot and is automatically guided and held on the central ladder stringer. The rungs of such a safety ladder can comprise single rungs, that is, rungs which extend alternately in opposite directions from the central ladder stringer, or twin rungs which extend in both directions.

In a known safety ladder of the above described kind (see to bulletin "FABA Steigschutz" (FABA Safety Ladder) of Fahrleitungsbau GmbH, D-4300, Essen 12, Germany, of October, 1983) the rungs are welded to the central ladder stringer on the rear transverse piece with the flat contacting surfaces in close contact with each other.

Welding is a comparatively expensive fastening means. Also the safety ladder requires a considerable amount of space during storage and transport to the site where it is to stand. Furthermore welding the rungs to the central ladder stringer at the place where the safety ladder is to stand is not feasible in practice. That is particularly true, when the safety ladder is not constructed of a stainless steel, or must be galvanized as a protection against corrosion.

In other safety ladders the rungs were fixed with the aid of bolts to the central ladder stringer. That is, however, because of the considerable number of rungs, also comparatively expensive.

Moreover the interior cross section of the central ladder stringer is unnecessarily reduced by the heads or nuts, so that the tethering device of the safety harness or belt must be constructed smaller or else the entire cross section of the central ladder stringer must be correspondingly enlarged.

OBJECTS OF THE INVENTION

The principal object of our invention is to provide a safety ladder of the above described kind, which, even with comparatively large permissible manufacturing tolerances allows simple, yet functional, complete and satisfactory rung mounting.

It is a general object of our invention to provide an improved safety ladder.

It is also an object of our invention to provide an improved safety ladder, in which the rungs are attached to the ladder stringer in a better way than those of the prior art.

It is also an object of our invention to provide an improved safety ladder, in which the means of fastening the rungs to the ladder stringer allows for assembly of the completed ladder easily, but in such a way that the ladder may be stored and transported in a smaller space than if its components were completely assembled.

It is also an object of our invention to provide an improved safety ladder, in which the rungs are mounted on the central ladder stringer, so that the climbing forces are distributed uniformly and optimally, and the interior of the central ladder stringer is completely free of obstructions, protrusions, and the like, but the means of attaching rungs to the central ladder stringer does not impair any corrosion protection measures already taken.

SUMMARY OF THE INVENTION

These objects and others which will become apparent hereinafter are attained in accordance with our invention in a safety ladder comprising a vertical central ladder stringer and a plurality of horizontal rungs, wherein the central ladder stringer has a substantially C-shaped cross section with a front longitudinal slot, a substantially planar rear transverse piece with rounded longitudinal edges, and wherein the rungs applied in the vicinity of the rear transverse piece from the outside to the central ladder stringer are attached thereto, and are bent forwardly at their free outer members.

According to our invention each of the rungs is provided with a recess, preferably with an equal sided and trapezoidally shaped cross section, receiving the rear transverse piece of the central ladder stringer, by which the rungs applied to the central ladder stringer are set riderlike contacting only in the vicinity of the longitudinal edges on the central ladder stringer, i.e. straddle the longitudinal edges with the flanks of the recess in direct contact with the rounded longitudinal edges.

The rungs are attached to the central ladder stringer by a fastening means which does not obstruct the interior of the central ladder stringer.

Our invention is based upon the elimination of problems caused by manufacturer's tolerances by a riderlike or straddle mounting of the rungs on the outer periphery of the central ladder stringer.

At the same time this riderlike mounting leads to an optimal bearing and guiding (transfer) of the forces occurring in climbing of the safety ladder. Simultaneously the interior of the central ladder stringer can remain completely unobstructed. In any case the fastening means allows also subsequent mounting of the rungs without injuring a previously applied corrosion protection means.

The rungs, as is known in the prior art, can be constructed as a forged piece. According to a preferred embodiment of our invention, however, the rungs are bent from a bar or girder section.

The fastening means can comprise a locking connector, for example with a locking tip engageable in a locking recess in the rung and/or in the central ladder stringer or rear transverse piece. In a particularly secure and easy preferred embodiment the fastening means comprises at least one rivet, which penetrates the rear transverse piece and the rung.

BRIEF DESCRIPTION OF THE DRAWING

The above and other objects, features, and advantages of our present invention will become more readily apparent from the following description, reference being made to the accompanying highly diagrammatic drawing in which.

SPECIFIC DESCRIPTION

Figure 1:
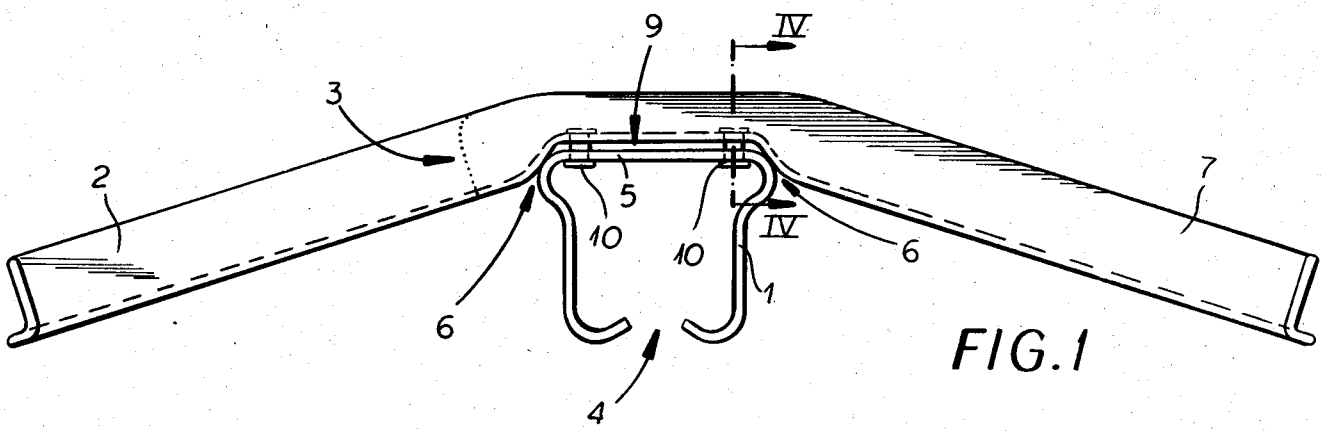
FIG. 1 is a top plan view of a preferred embodiment of a safety ladder rung structure according to our invention.
Figure 2:
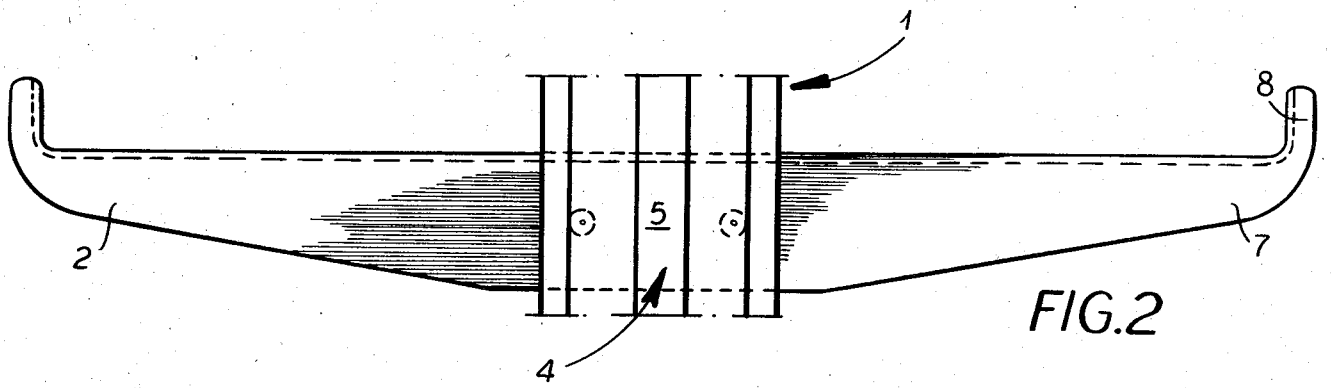
FIG. 2 is a front view of a part of the safety ladder rung structure according to FIG. 1.
Figure 3:
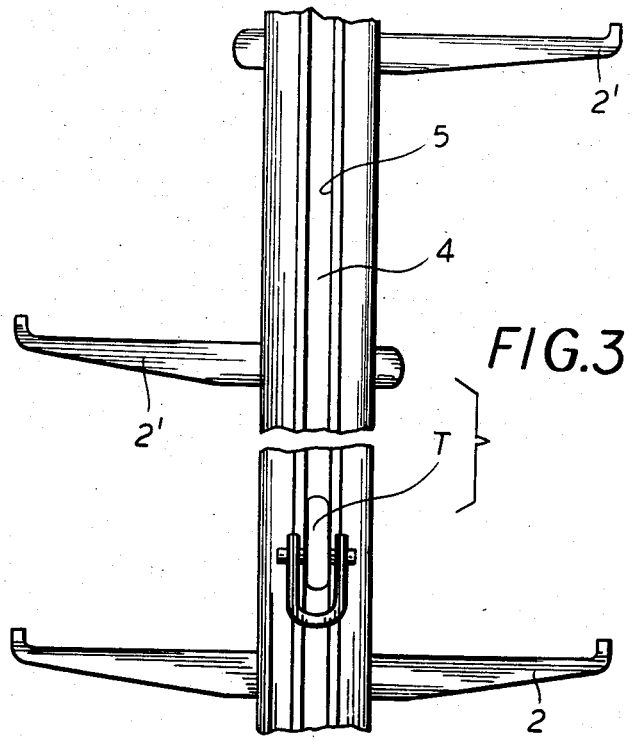
FIG. 3 is an elevational view of a ladder using the rung struction of FIGS. 1 and 2.

The safety ladder shown in the drawing comprises a vertical central ladder stringer or channel 1 and a plurality of horizontal rungs 2 and 2'. From FIGS. 1 and 3 one sees, that at least some of the rungs are twin rungs 2. An alternative preferred embodiment in which at least some of the rungs are single rungs 2' is indicated by the dotted line 3 in FIG. 1 and in FIG. 3.

The central ladder stringer 1 has a C-shaped cross section with a front longitudinal slot 4. The rear transverse piece 5 opposite the front longitudinal slot 4 is substantially planar, which does not exclude it from having projecting bulges, which act to help hold the tethering device T in a close fit. The tethering device T has rollers (see the aforementioned bulletin), guided in the track formed by the stringer 1. On both longitudinal ends of the rear transverse piece 5 a bulged out and in any case rounded longitudinal edge 6 is provided. The rungs 2 are applied to the central ladder stringer 1 in the vicinity of the rear transverse piece 5 from the outside and are attached to them. Additionally one learns from FIG. 1, that the rungs are bent with their free outer members 7 forward, so that the upwardly turned free outer ends 8 lie in the plane of the front longitudinal slot 4.

The rungs 2 and 2' are each provided with an equal sided trapezoidally cross sectioned recess 9 for the rear transverse piece 5. With this recess 9 the rungs 2 and 2' are set on the central ladder stringer 1, so as to straddle the rear thereof, and of course in such a way, that the inclined flanks of the trapezoid section contact only in the vicinity of the rounded longitudinal edges 6 on the central ladder stringer 1. In this position they are then attached with the central ladder stringer 1 by a fastening means.

Figure 4:
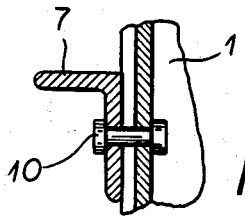
FIG. 4 is a section along line IV—IV of FIG. 1.

As one sees from a comparative study of the drawings, the rungs 2 are bent from an L-shaped bar or girder section. The fastening means 10 (FIG. 4) in this embodiment comprises a rivet or pin, which penetrates both the rear transverse piece 5 and the rung 2. It is understood because of the riderlike position of the rungs 2, that a small clearance between the rungs 2 and the rear transverse piece 5 is tolerated, in order to accommodate a corresponding variation within the tolerances of the components.

We claim:

1. In a safety ladder comprising a vertical central ladder stringer and a plurality of horizontal rungs, wherein said central ladder stringer has a substantially C-shaped cross section with a front longitudinal slot, a rear transverse piece lying opposite to said front longitudinal slot, and said rear transverse piece having rounded longitudinal edges, and each of said rungs is applied to said central ladder stringer in the vicinity of said rear transverse piece from the outside and is attached thereto, and has an outer member bent forwardly, the improvement wherein each of said rungs is provided with an equal sided trapezoidally shaped recess for said rear transverse piece, by which each of said rungs straddles said central ladder stringer contacting only in the vicinity of said longitudinal edges on said central ladder stringer, and each of said rungs is attached to said central ladder stringer by a fastening means for interconnecting the rung at the rear transverse piece without obstructing the interior of said stringer.

2. The improvement defined in claim 1 wherein each of said rungs is bent from a bar section.

3. The improvement defined in claim 1 wherein said fastening means comprises at least one rivet, which penetrates said rear transverse piece and said rung.

4. In a safety ladder comprising a vertical central ladder stringer and a plurality of horizontal rungs, wherein said central ladder stringer has a sunbstantially C-shaped cross section with a front longitudinal slot, a rear transverse piece lying opposite to said front longitudinal slot, and said rear transverse piece having longitudinal edges, and each of said rungs applied to said central ladder stringer in the vicinity of said rear transverse piece from the outside is attached thereto, the improvement wherein each of said rungs is provided with a recess shaped to engage said rear transverse piece, by which each of said rungs straddles said transverse piece contacting only in the vicinity of said rounded longitudinal edges on said central ladder stringer, and each of said rungs is attached to said stringer by a fastener which does not obstruct the interior of said ladder stringer.

5. The improvement defined in claim 4 wherein said recess has a substantially equal sided, trapezoidally shaped cross section.

6. The improvement defined in claim 5 wherein said fastener comprises a rivet.

7. The improvement defined in claim 5 wherein said fastener is a locking connector engageable in each of said rungs.

* * * * *